US006422270B2

(12) United States Patent
Nakada et al.

(10) Patent No.: US 6,422,270 B2
(45) Date of Patent: Jul. 23, 2002

(54) WEFT SELVAGE TUCK-IN NOZZLE INJECTION TIMING APPARATUS

(75) Inventors: Akihiko Nakada; Shigeharu Sawada, both of Kanazawa (JP)

(73) Assignee: Tsudakoma Kogyo Kabushiki Kaisha, Ishikawa (JP)

( * ) Notice: Subject to any disclaimer, the term of this patent is extended or adjusted under 35 U.S.C. 154(b) by 0 days.

(21) Appl. No.: 09/909,881

(22) Filed: Jul. 23, 2001

(30) Foreign Application Priority Data

Jul. 21, 2000 (JP) ..... 2000-220962
Jul. 3, 2001 (JP) ..... 2001-202595

(51) Int. Cl.[7] ..... D03D 47/48
(52) U.S. Cl. ..... 139/434
(58) Field of Search ..... 139/434, 194, 139/435.4

(56) References Cited

U.S. PATENT DOCUMENTS 4,957,144 A * 9/1990 Watanabe et al. ..... 139/434
6,109,308 A * 8/2000 Yoneda et al. ..... 139/302
6,240,976 B1 * 6/2001 Satoh et al. ..... 139/434

FOREIGN PATENT DOCUMENTS

JP 6-16952 5/1994

* cited by examiner

*Primary Examiner*—Andy Falik
(74) *Attorney, Agent, or Firm*—Connolly Bove Lodge & Hutz LLP

(57) ABSTRACT

A tuck-in apparatus for producing a fastened tuck-in-selvage includes a tuck-in nozzle for injecting air into a warp shed from the outside of a warp array in order to fold back a weft yarn end toward a cloth fell. A selvage-fastening nozzle is disposed adjacent to the cloth fell outside the warp array for causing the weft yarn end folded back by the tuck-in nozzle to extend along the cloth fell. Timing control is provided to provide a first period of air injection from the tuck-in nozzle and a second period of air injection from the selvage-fastening nozzle so that the beginning of the second period is later than the beginning of the first period, and the second period ends before the warp shed is closed.

4 Claims, 8 Drawing Sheets

WEFT SELVAGE TUCK-IN NOZZLE INJECTION TIMING APPARATUS

BACKGROUND OF THE INVENTION

1. Field of the Invention

This invention relates to a tuck-in apparatus for a weaving loom.

2. Description of the Related Art

One known type of a pneumatic tuck-in apparatus as disclosed in published Japanese Examined Utility Model Application No. 6-16952 includes a body disposed outside a warp yarn end, tuck-in nozzles disposed in the body, the nozzles having two axes extending in an intersecting relationship to one another, in which air blowing from one of the nozzles folds back a proximal end of a weft yarn end, while air blowing from the other nozzle drives a distal end of the weft yarn end toward a cloth fell, both of the nozzles continue to blow air until weft insertion or beating is completed.

Although one of the tuck-in nozzles need not continue to blow air until the end of the weft insertion after the weft yarn end is folded back, it must continue to blow air because these two nozzles are communicated to a single air passage in the body. As a result, a large quantity of air is consumed in total. Similarly, the other nozzle must uselessly continue to blow air. In order to reduce a period of time for a blast of air, the nozzles may be caused to stop blowing air after the weft yarn end is folded back, but may be allowed to resume blowing air immediately before the closing of a warp shed in order to force the weft yarn end toward the cloth fell. However, one of these two nozzles that simultaneously blow air is again unnecessary, and a large quantity of air is consumed after all.

A needle type tuck-in apparatus is designed to insert and swing a needle into the warp shed through between warp yarns so as to extend outside the warp arrays in order to grip the weft yarn end by means of a distal end of the needle, and thereafter to release the weft yarn end and then swing the needle so as to pull the needle out of the warp shed, thereby folding back the weft yarn end toward the cloth fell. This system slackens the weft yarn end without any constraint imposed by the needle, and consequently often produces a loosened tuck-in selvage. A countermeasure for avoiding such a shortcoming is that timing in which the needle is pulled from the warp shed is delayed until immediately before the closing of the warp shed in order to allow the warp yarns to retain the weft yarn end at the same time when the weft yarn end is released.

While the above countermeasure provides a successfully fastened tuck-in selvage, increased contact between the needle and the warp yarns damages the warp yarns, resulting in woven fabric defects such as a needle trace.

An object of the present invention as defined in claim 1 is to provide a tuck-in apparatus developed in view of the above and designed to provide a successfully fastened tuck-in selvage without unnecessary air blowing, with a consequential reduction in manufacturing cost.

Another object of the present invention as defined in claim 2 is to provide a tuck-in apparatus designed to form a woven fabric having a successfully fastened tuck-in selvage without needle traces.

A further object of the present invention as defined in claim 3 is to provide a tuck-in apparatus adapted for different weaving conditions such as kinds of weft yarns.

SUMMARY OF THE INVENTION

An aspect of the present invention as defined in claim 1 provides a tuck-in apparatus including a tuck-in nozzle for injecting air into a warp shed from the outside of warp arrays in order to fold back a weft yarn end toward a cloth fell, characterized by: a selvage-fastening nozzle disposed adjacent to the cloth fell outside the warp arrays for causing the weft yarn end folded back by the tuck-in nozzle to extend along the cloth fell, wherein air injection from the tuck-in nozzle and that from the selvage-fastening nozzle are separately controllable, and wherein air injection start timing of the selvage-fastening nozzle is later than that of the tuck-in nozzle, but is set to be put before the warp shed is closed.

The phrase "a selvage-fastening nozzle disposed adjacent to the cloth fell outside the warp arrays for causing the weft yarn end folded back by the tuck-in nozzle to extend along the cloth fell" means that a woven fabric edge of the cloth fell lies within a range of air injection from the selvage-fastening nozzle. As a specific example, a nozzle holder including a weft yarn end-introducing slit is provided with the tuck-in nozzle and the selvage-fastening nozzle. More specifically, a selvage-fastening holder has an injection orifice positioned adjacent to the cloth fell and opened through a side surface of the nozzle holder toward the warp arrays. The woven fabric edge of the cloth fell lies within a range of air injection.

The phrase "air injection start timing of the selvage-fastening nozzle is later than that of the tuck-in nozzle" means that the air injection start timing of the selvage-fastening nozzle is earlier than, simultaneous with, and later than air injection end timing of the tuck-in nozzle. When the former is earlier than the latter, then air injection timing of the selvage-fastening nozzle overlaps with that of the tuck-in nozzle. When the former is simultaneous with and later than the latter, then there is no overlap between the air injection timing of the selvage-fastening nozzle and that of the tuck-in nozzle. The absence of such an overlap means that the air injection timing of the selvage-fastening nozzle is delayed with reference to that of the tuck-in nozzle, but continues at least until the warp shed is closed. The phrase "but continues at least until the warp shed is closed" means that air injection is allowed to stop before the warp shed is closed, and is also allowed to resume after the warp shed is closed. Since air blowing after the closing of the warp shed exercises no influences on how a tuck-in selvage is fastened, it is ideally desirable in view of cost that the air injection timing ends just with or immediately before the closing of the warp shed. However, since a tuck-in operation is effected instantly, it is difficult to match the end of the tuck-in operation exactly with the closing of the warp shed.

While one aspect of the invention as defined in claim 1 is directed to the pneumatic tuck-in apparatus, another aspect of the invention as defined in claim 2 provides a tuck-in apparatus having a needle swung and thereby inserted into a warp shed through between warp yarns so as to extend outside warp arrays in order to grip a weft yarn end, the needle being thereafter swung to be pulled out of the warp shed, thereby releasing and then folding back the weft yarn end toward the cloth fell, characterized by: a selvage-fastening nozzle disposed adjacent to the cloth fell outside the warp arrays for causing the weft yarn end folded back by the needle to extend along the cloth fell, wherein air injection timing of the selvage-fastening nozzle may continue between the moment the need releases the weft yarn end and at least the moment the warp shed is closed.

The selvage-fastening nozzle may be immovable in the direction of the warp, or alternatively may be provided so as to be movable in the direction of the warp, as defined in claim 3.

The phrase "the selvage-fastening nozzle may be provided so as to be movable" means that the single selvage-fastening nozzle may be movably provided, or alternatively the selvage-fastening nozzle integrally combined with the tuck-in nozzle may be movably disposed. As defined in claim 3, for different weaving conditions such as a kind of the weft, a weft density, and a woven fabric structure, the selvage-fastening nozzle can be moved near the cloth fell, even when the cloth fell moves toward the warp.

DESCRIPTION OF THE PREFERRED EMBODIMENTS

Figure 1:
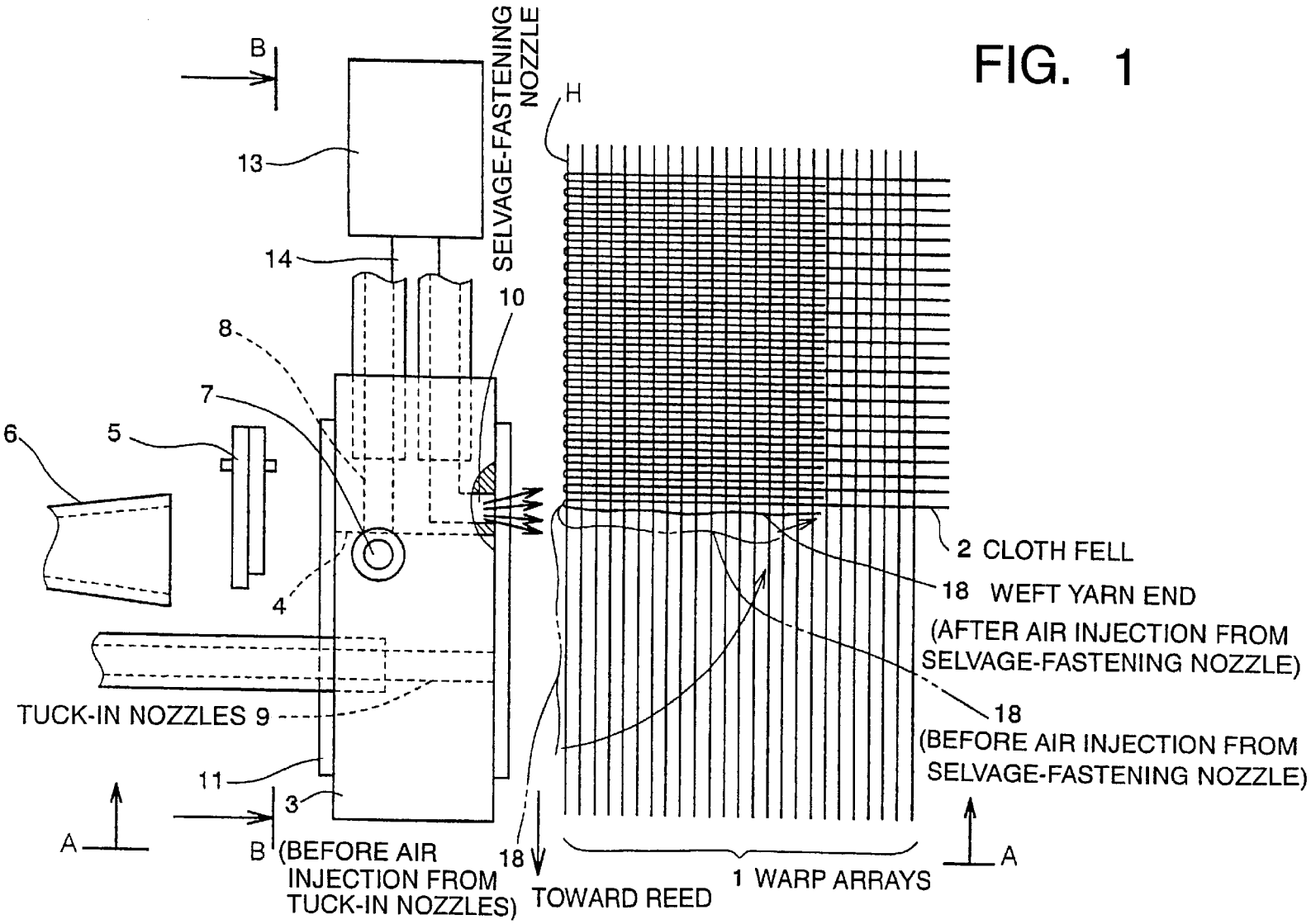
FIG. 1 is a plan view, illustrating a partially cutaway cross-section of a tuck-in apparatus according to a first embodiment of the present invention.

FIGS. 1–4 illustrate a first embodiment of a tuck-in apparatus according to the present invention. In the first embodiment, a block-shaped nozzle holder 3 is disposed adjacent to a cloth fell 2 outside warp arrays 1 so as to be movable in a direction of warp yarns. The nozzle holder 3 includes a weft yarn end-introducing slit (hereinafter called a slit) 4, which is open in three directions, i.e., a direction toward the warp arrays, a direction opposite to the warp arrays, and a direction toward a reed. An inner part of the slit 4 is positioned slightly toward the reed with respect to he cloth fell 2. A cutter 5 and a weft suction hose 6 paced apart from the cutter 5 are disposed in the direction opposite to the warp arrays with reference to the inner part of the slit 4. The nozzle holder 3 includes a weft yarn end-griping nozzle (hereinafter called a griping nozzle) 7, a griping hole 39, a weft yarn end-releasing nozzle (hereinafter called a releasing nozzle) 8, a pair of tuck-in nozzles 9, and a selvage-fastening nozzle 10. The tuck-in nozzles 9 positioned toward the reed with respect to the cloth fell 2 are disposed one above another in relation to warp line "W." The selvage-fastening nozzle 10 located on warp line "W" is disposed adjacent to the cloth fell 2. Air injection from the tuck-in nozzle 9 and that from the selvage-fastening nozzle 10 are separately controllable. Reference character "H" denotes a woven fabric edge.

Figure 2:
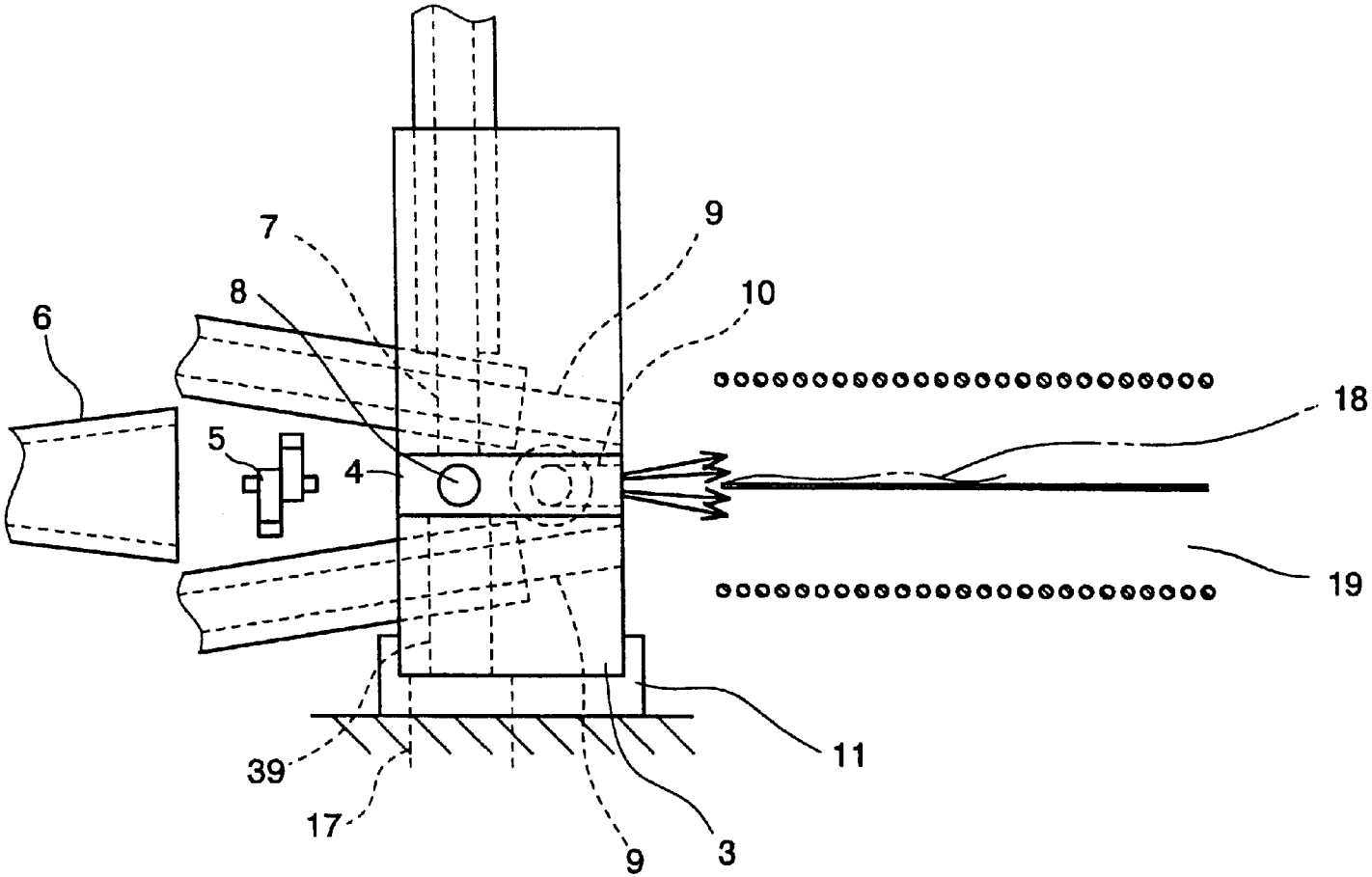
FIG. 2 is a view taken along line A—A of FIG. 1 in the direction of the arrows.
Figure 3:
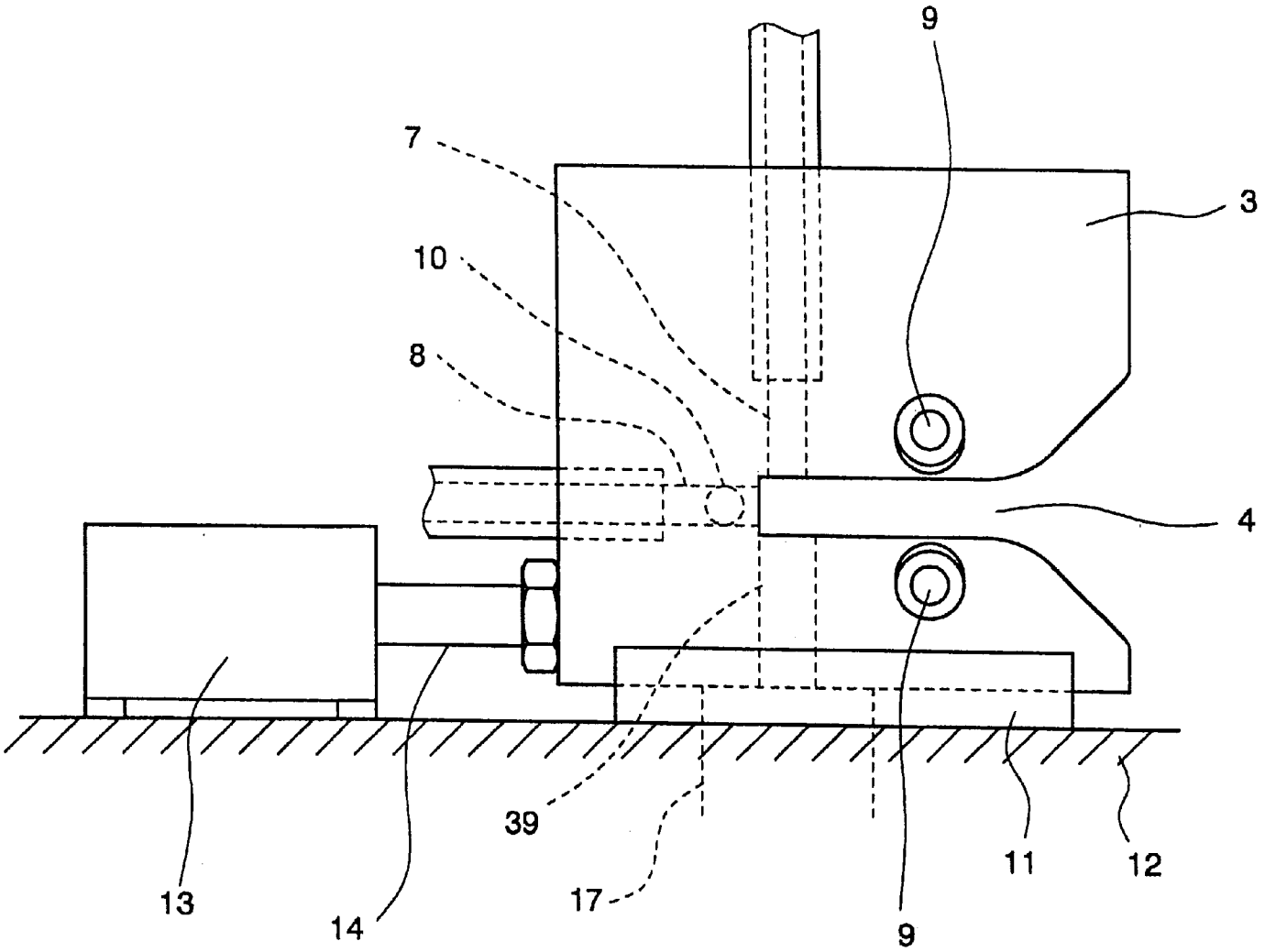
FIG. 3 is a view taken along line B—B of FIG. 1 in the direction of the arrows.
Figure 4:
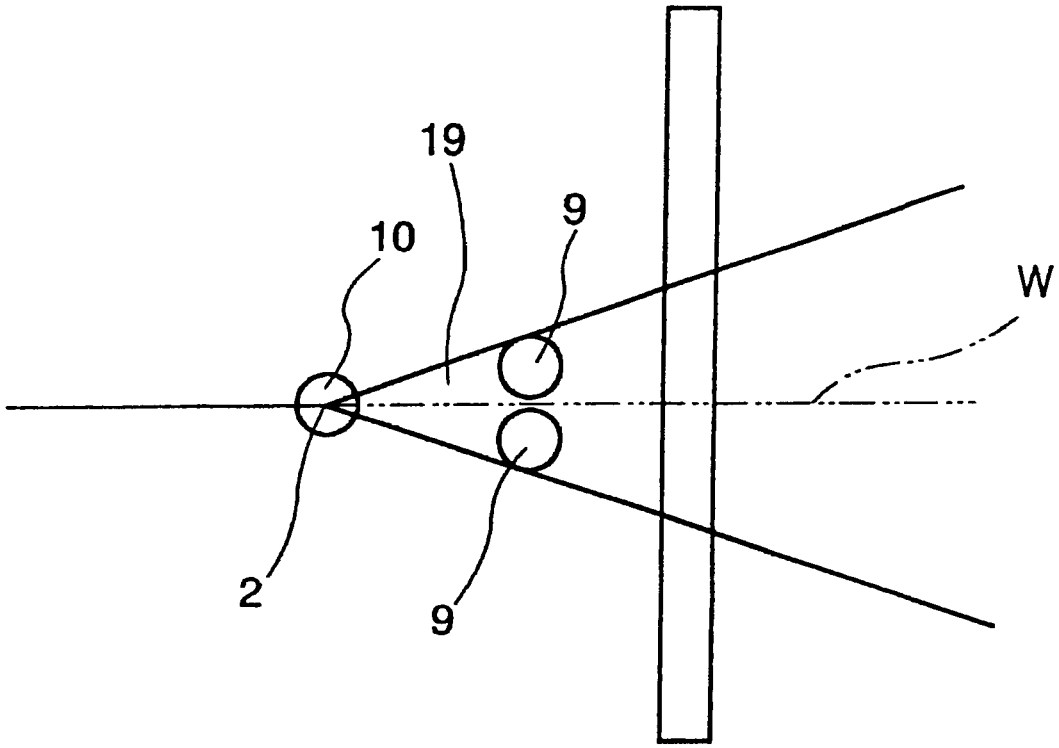
FIG. 4 is a side view, illustrating a warp shed in order to describe how a selvage-fastening nozzle is positioned.
Figure 5:
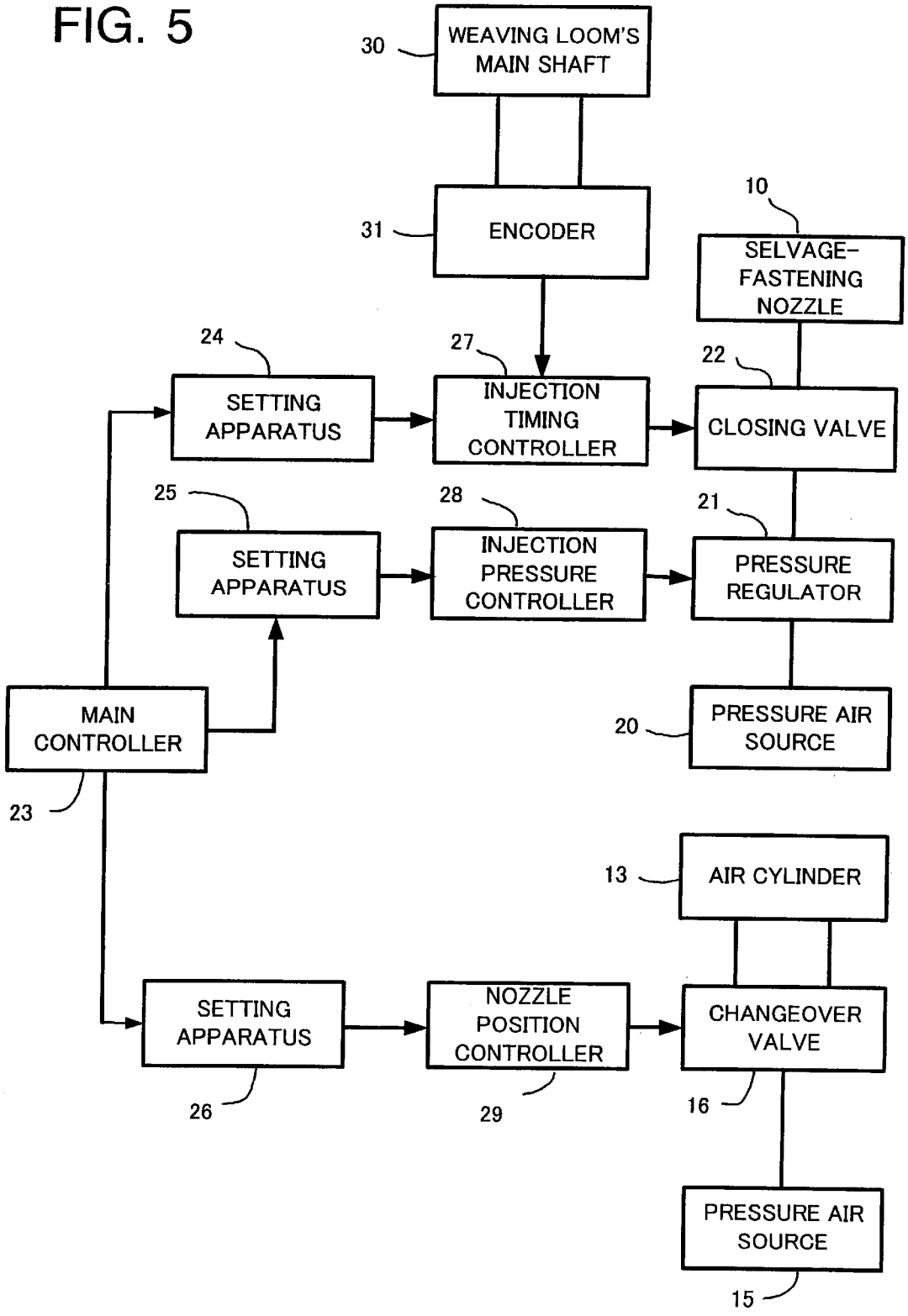
FIG. 5 is a block diagram, illustrating how the selvage-fastening nozzle is controlled.

As illustrated in FIGS. 2 and 3, a structure for allowing the nozzle holder 3 to move in the direction of warp yarns includes an upward open slide base 11 fixedly positioned on a frame 12 and an air cylinder 13 rigidly disposed on the frame 12 in the direction opposite to the reed with respect to the slide base 11 and having a piston rod 14 connected to the nozzle holder 3 at a lower portion thereof. The slide base 11 having a nearly U-shaped cross-section serves as a guide. As illustrated in FIG. 5, air is introduced into the air cylinder 13 from a pressure air source 15 via a changeover valve 16. The changeover valve 16 is switched to control both an airflow direction and a supply of air in the air cylinder 13.

As illustrated in FIGS. 1–3, the griping nozzle 7 extends to the slit 4 from an upper surface of the nozzle holder 3, and has an injection orifice open to the inner part of the slit 4. The slit 4 is formed with the griping hole 39 that directly faces the griping nozzle 7. The griping hole 39 extends to the underside of the nozzle holder 3. In the slide base 11 and the frame 12, a passage 17 for releasing air from the griping hole 39 is formed as an elongated hole that extends in the direction of the warp yarns with respect to the griping hole 39 in order to accommodate movement of the nozzle holder 3.

The releasing nozzle 8 extends to the slit 4 from a surface of the nozzle holder 3 opposite to the reed, and has an injection orifice open to the inner part of the slit 4.

The tuck-in nozzles 9 located toward the reed with respect to the griping nozzle 7 and positioned one above another in relation to the slit 4 extend in the nozzle holder 3 through both side surfaces thereof in a transverse direction of a fabric. The tuck-in nozzles 9 have respective injection orifices open to a side surface of the warp arrays. The tuck-in nozzles 9 are both slanted to be gradually closer to the slit 4 as the injection orifices are reached, and direct an air blast at a central portion of the entire length of a weft yarn end 18 discharged from the slit 4, thereby folding back the weft yarn end 18 inside a warp shed 19.

The selvage-fastening nozzle 10 positioned toward the warp arrays with respect to the releasing nozzle 8 extends from a surface of nozzle holder 3 opposite to the reed toward the slit 4, but curves toward the warp arrays in a L-shaped fashion before reaching the slit 4. The selvage-fastening nozzle 10 has an injection orifice open at the side surface of the nozzle holder 3 toward the warp arrays adjacent to the cloth fell. The woven fabric edge of the cloth fell lies within a range of air injection.

In order to independently control air injection from both the tuck-in nozzles 9 and the selvage-fastening nozzle 10, air is introduced into the selvage-fastening nozzle 10 from the pressure air source 20 via a pressure regulator 21 and a closing valve 22 as illustrated in FIG. 5, while air is introduced into the tuck-in nozzles 9 via another passage although not being illustrated in the drawings.

In order to optimize the injection timing, injection pressure, and position of the selvage-fastening nozzle 10 in accordance with different weaving conditions, automatic control as described below is practiced. When desired weaving conditions are entered into a main controller 23, then the controller 23 sends out signals to setting apparatus 24, 25, 26 that are employed for the injection timing, injection pressure, and position of the selvage-fastening nozzle 10, which signals meet the desired weaving conditions. In the setting apparatus 24, 25, 26, optimal setting conditions for different weaving conditions are entered in advance. The setting apparatus 24, 25, 26 select such optimal setting conditions in accordance with the signals from the main controller 23, and then transmit the selected signals to controllers 27, 28, 29.

More specifically, the setting apparatus 24 for an injection timing application feeds to an injection-timing controller 27 optimal start and end angles of a weaving loom's main shaft 30 in accordance with the entered weaving conditions, while an encoder 31 transmits an angle of the main shaft 30 to the injection timing controller 27. When the angle of the main shaft 30 coincides with the start angle, then the injection-timing controller 27 sends out a valve-opening signal to the closing valve 22. When the angle of the main shaft 30 received from the encoder 31 coincides with the end angle, then the injection-timing controller 27 sends a valve-closing signal to the closing valve 22.

The setting apparatus 25 for an injection pressure application feeds to an injection pressure controller 28 optimal pneumatic pressure data in accordance with the entered weaving conditions. The injection pressure controller 28 sends to the pressure regulator 21 a control signal that meets the optimal pneumatic pressure data.

The setting apparatus 26 for a selvage-fastening nozzle position feeds to a nozzle position controller 29 an optimal selvage-fastening nozzle position in accordance with the entered weaving conditions. The nozzle position controller 29 calculates a distance between a present position of the selvage-fastening nozzle and a position where the selvage-fastening nozzle is to be moved, and then feeds a control signal to the changeover valve 16 according to results of the calculation.

Tuck-in steps according to the first embodiment will now be described with reference to FIG. 6. Initially, an inserted weft yarn is beaten, and is then positioned in the slit 4 at the inner part thereof. Next, the weft yarn is cut by a cutter 5, and then the remaining end of the weft yarn is drawn by a weft suction hose 6. The griping nozzle 7 blows air downward immediately after the above suction, thereby griping a distal end of the weft yarn end 18 in the griping hole 39. Subsequently, the releasing nozzle 8 blows air in the direction of the warp immediately after the end of the air blowing from the griping nozzle 7, thereby discharging the weft yarn end 18 from the slit 4. In this way, the weft yarn end 18 is bent as if it extends in the direction of the warp. (See FIG. 1.) The tug-in nozzles 9 direct an air blast at the central portion of the entire length of the weft yarn end 18 after the end of the air blowing from the releasing nozzle 8, and the greatly bent and loosened weft yarn end 18 is thereby brought toward the cloth fell 2. When a certain period of time elapses after the end of the air blowing from the tuck-in nozzles 9, the selvage-fastening nozzle 10 starts blowing air immediately before the warp shed is closed. A proximal end of the weft yarn end 18, which exhibits greater resistance to bending because the woven fabric edge "H" of the cloth fell 2 lies within the range of air injection and further because the proximal end of the weft yarn end 18 is folded back, is directly blown by air, thereby operatively extending the weft yarn end 18 substantially parallel to the cloth fell 2. Thereafter, the closed warp shed causes the warp yarns to contact the weft yarn end 18, and the weft yarn end 18 remains elongated. (FIG. 1 evidently illustrates how the weft yarn end 18 is elongated.) The selvage-fastening nozzle 10 stops blowing air immediately after the closing of the warp shed, and the weft yarn end 18 is beaten together with the following weft yarn, thereby forming a fastened tuck-in selvage.

Figure 6:
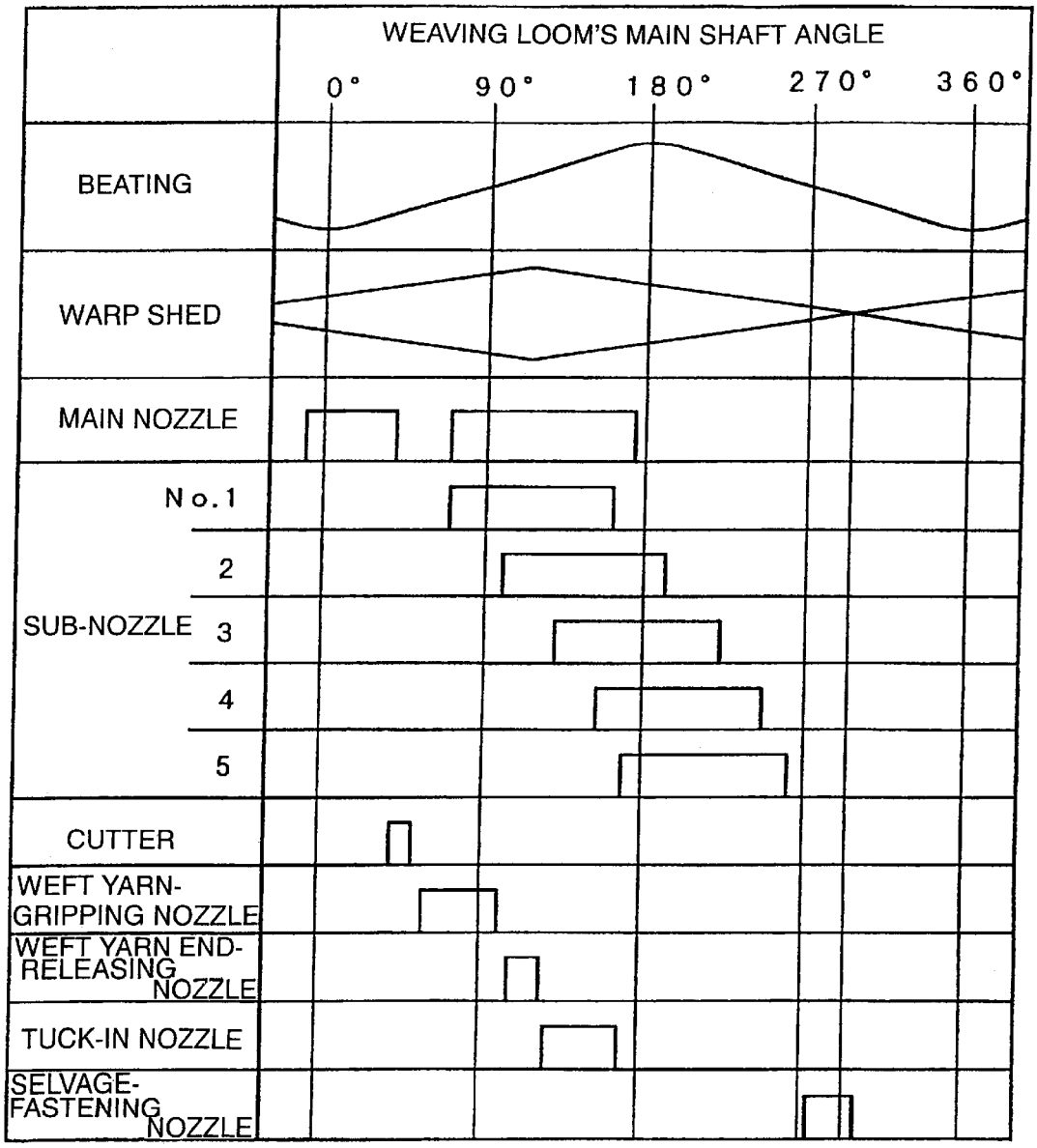
FIG. 6 is a timing diagram, illustrating tuck-in steps.
Figure 8:
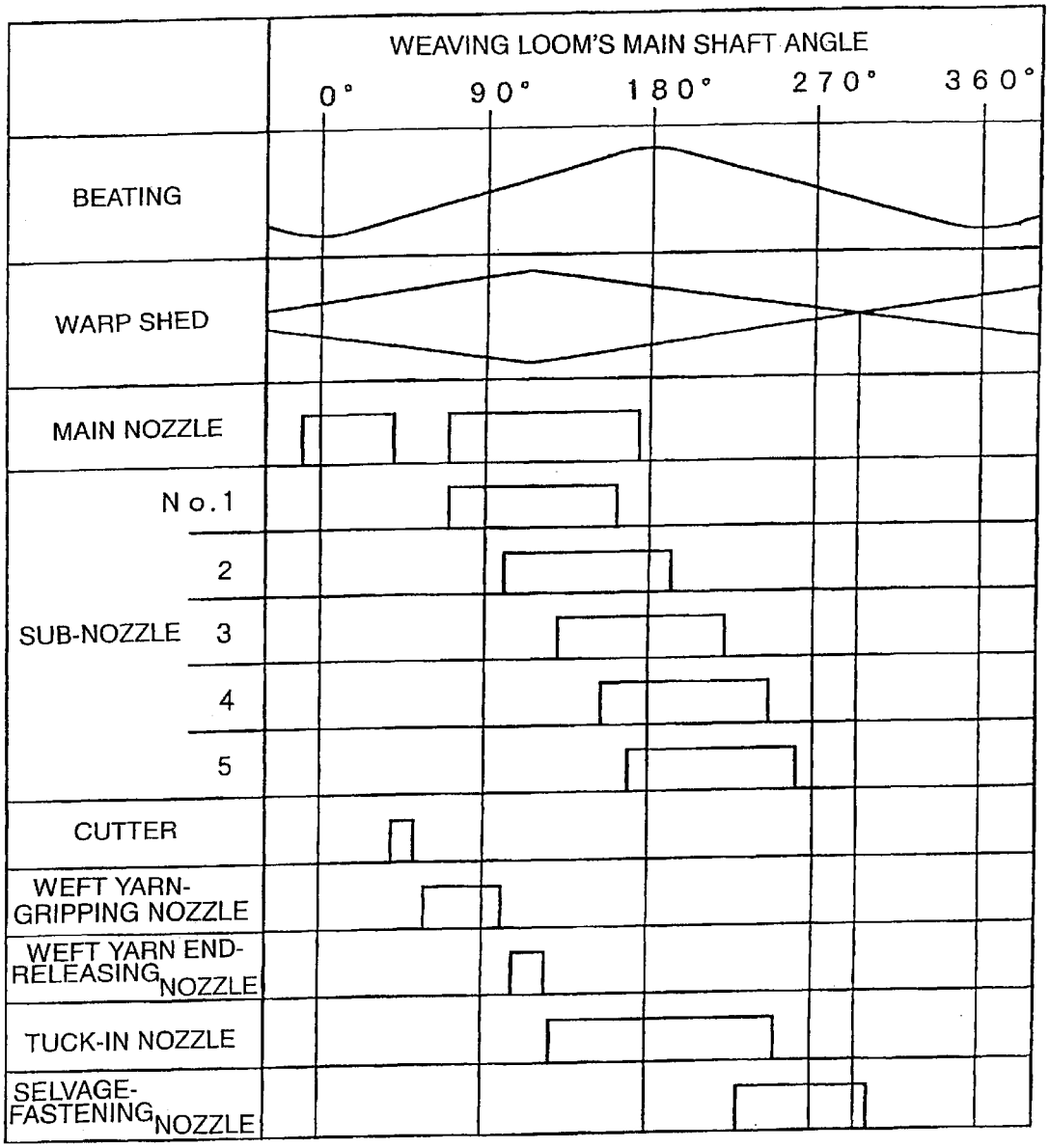
FIG. 8 is another timing diagram, illustrating tuck-in steps.

As seen from FIG. 6, there is no overlap between air injection timing of the tuck-in nozzles 9 and that of the selvage-fastening nozzle 10, as previously described. In this case, considerably reduced air consumption is achievable. As illustrated in FIG. 8, it is also acceptable that the air injection timing of the tuck-in nozzles 9 partially overlaps with that of the selvage-fastening nozzle 10. Accordingly, air injection end timing of the tuck-in nozzles 9 may be delayed to approach timing in which the warp shed is closed, with the result that the weft yarn end 18 can reliably be bent to come closer to the cloth fell 2. Air injection start timing of the selvage-fastening nozzle 10 may be hastened, thereby making it possible to reliably provide an elongated weft yarn end 18. As a result, a further fastened and satisfactory tuck-in selvage is formed.

In order to reduce the volume of air consumption, air injection end timing of the selvage-fastening nozzle 10 may be set to be put before the closing of the warp shed. (Not shown) However, there are cases where such hastened air injection end timing causes the weft yarn end 18 elongated by air blow from the selvage-fastening nozzle 10 to shrink to a certain extent during time lapse between the end of such air injection and the closing of the warp shed, depending upon kinds of woven fabrics. As a result, a poorly fastened tuck-in selvage is formed. Therefore, the air injection end timing of the selvage-fastening nozzle 10 may be set to be placed before the closing of the warp shed, but within a limit in which an insufficiently fastened tuck-in selvage is permissible as a commercially marketable product.

Figure 7:
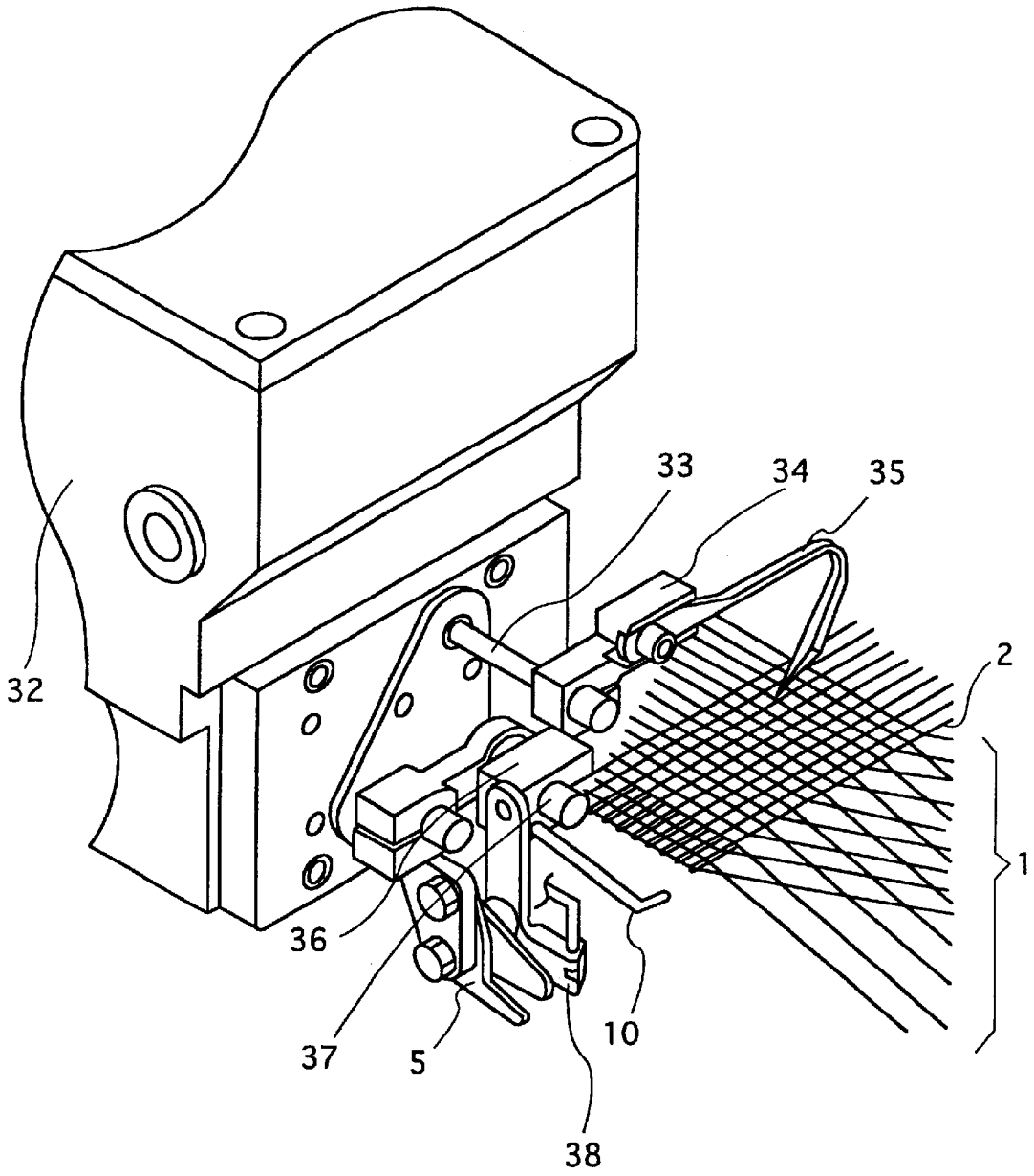
FIG. 7 is a perspective view, illustrating a tuck-in apparatus according to a second embodiment.

FIG. 7 illustrates a second embodiment of a tuck-in apparatus according to the present invention, in which a main body 32 is disposed adjacent to the cloth fell 2 outside warp arrays 1. A needle shaft 33 extends outwardly from the main body 32. A needle-retaining block 34 is fixed to the needle shaft 33 at a distal end thereof. A needle 35 is secured to the block 34 so as to be swingable about the needle shaft 33 and further to be movable in the direction of the warp in union with the needle shaft 33 advanced and retracted with respect to the main body 32. For beating, the needle 35 is moved in the direction opposite to the reed. A gripper head-retaining block 36 has a gripper head 38 mounted thereon for griping the weft yarn end, and further has a selvage-fastening nozzle 10 fixed to the gripper head-retaining block 36. The selvage-fastening nozzle 10 is bent into a L-shape. A gripper shaft 37 on which the gripper head-retaining block 36 is fixedly positioned is advanced and retracted with respect to the body 32, and the selvage-fastening nozzle 10 is thereby allowed to move in the direction of the warp. For beating, the selvage-fastening nozzle 10 is moved in the direction opposite to the reed.

Tuck-in steps according to the second embodiment essentially includes the steps of: swinging the needle 35 and thereby inserting the needle 35 into a warp shed through between warp yarns in order to extend outside the warp arrays 1; inserting a distal end of the weft yarn end 18 gripped by the gripper head 38 into a string-penetrating hole or hook (not shown) of the needle 35 at a distal end thereof, thereby gripping the weft yarn end 18; swinging the needle 25 in an opposite direction, thereby introducing the weft yarn end 18 into the warp shed; pulling the needle 35 from the warp shed after withdrawal of the weft yarn end 18 through the string-penetrating hole; and, permitting the selvage-fastening nozzle 10 to blow air immediately before the closing of the warp shed. The air blowing from the selvage-fastening nozzle 10 forms a fastened tuck-in selvage. The timing in which the weft yarn end 18 is pulled through the string-penetrating hole or hook is intentionally delayed until the moment before the closing of the warp shed, thereby eliminating the need for holding the weft yarn end 18 between the warp yarns in order to avoid loosening the weft yarn end 18. The pulling of the needle 35 out of the warp shed before an opening amount of the warp shed decreases substantially eliminates a possibility that the needle 5 contacts the warp yarns. As a result, a woven fabric without any needle trace can be formed.

In the tuck-in apparatus according to an aspect of the present invention as defined in claim 1, air injection start timing of the selvage-fastening nozzle is later than that of the tuck-in nozzle, but is set to be put before the warp shed is closed. The warp shed is closed while the weft yarn end remains elongated by the air blowing, and contact of the warp with the weft yarn end upon the closing of the warp shed retains the elongated weft yarn end. The subsequent beating results in a fastened tuck-in selvage.

The air injection from the tuck-in nozzles and that from the selvage-fastening nozzle are independently controlled, while the air injection start timing of the selvage-fastening nozzle is later than that of the tuck-in nozzle, but is set to be put before the warp shed is closed. As a result, a less air consumption than in the past is achievable. Furthermore, since the tuck-in nozzles function to fold back the weft yarn end, while the selvage-fastening nozzle serves to force the folded weft yarn end to extend along the cloth fell, the pneumatic pressures of the respective nozzles are set to a degree required for respective functions of the nozzles, resulting in a reduced air consumption. Moreover, the tuck-in nozzles and the selvage-fastening nozzle are disposed at the most efficient positions to serve their functions, and further reduced air consumption is attainable. A synergetic effect caused by these advantages significantly reduces production costs.

Similarly to the aspect of the present invention as claimed in claim 1, another aspect of the invention as defined in claim 2 provides a fastened tuck-in selvage as well as allowing the weft yarn end to remain elongated and extending along the cloth fell by the selvage-fastening nozzle, even when swinging of the needle to pull the needle out of the warp shed is completed while the warp shed assumes a large opening width. As a result, a woven fabric having a good appearance resulting from a successfully fastened selvage without needle traces is provided.

According to a yet further aspect of the present invention as defined in claim 3, movement of the selvage-fastening nozzle in accordance with weaving conditions allows the selvage-fastening nozzle to always blow air at an optimal position, or rather adjacent to the cloth fell. As a result, further reduced air consumption is achievable, while successful selvage fastening is retained.

What is claimed is:

1. A tuck-in apparatus, comprising:

a tuck-in nozzle for injecting air into a warp shed from the outside of warp array in order to fold back a weft yarn end toward a cloth fell;

a selvage-fastening nozzle disposed adjacent to the cloth fell outside the warp array for causing the weft yarn end folded back by the tuck-in nozzle to extend along the cloth fell; and means for controlling a first period of air injection from said tuck-in nozzle and a second period of air injection from said selvage-fastening nozzle so that the beginning of the second period is later than the beginning of the first period, and the second period ends before said warp shed is closed.

2. A tuck-in apparatus, comprising:

means for swinging a needle in an out of a warp shed wherein a weft end is inserted and folded back toward the cloth fell;

a selvage-fastening nozzle disposed adjacent to the cloth fell outside the warp array for causing the weft yarn end folded back by the needle to extend along the cloth fell; and means for controlling a period of air injection from said selvage-fastening nozzle so that said period is within a range starting from a moment at which said needle releases the weft yarn end and ending at a moment at which said warp shed is closed.

3. A tuck-in apparatus as defined in claim 1, wherein the selvage-fastening nozzle is disposed so as to be movable in a direction of said warp yarns.

4. A tuck-in apparatus as defined in claim 2, wherein the selvage-fastening nozzle is disposed so as to be movable in a direction of said warp yarns.

* * * * *